US008575508B2

(12) United States Patent
Kashiwagi et al.

(10) Patent No.: US 8,575,508 B2
(45) Date of Patent: Nov. 5, 2013

(54) CURRENT SWITCH

(75) Inventors: Hironori Kashiwagi, Tokyo (JP); Daisuke Fujita, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/882,226

(22) PCT Filed: Dec. 16, 2010

(86) PCT No.: PCT/JP2010/072686
§ 371 (c)(1),
(2), (4) Date: Apr. 29, 2013

(87) PCT Pub. No.: WO2012/081108
PCT Pub. Date: Jun. 21, 2012

(65) Prior Publication Data
US 2013/0222088 A1 Aug. 29, 2013

(51) Int. Cl.
*H01H 9/44* (2006.01)
*H01H 9/30* (2006.01)

(52) U.S. Cl.
USPC ..... 218/23; 218/20; 200/254; 200/273; 335/201

(58) Field of Classification Search
USPC ..... 200/254, 273, 554; 335/201; 218/8, 9, 218/16, 17, 18, 20–28, 30
See application file for complete search history.

(56) References Cited

U.S. PATENT DOCUMENTS

| | | | |
|---|---|---|---|
| 8,263,890 | B2 | 9/2012 | Fujita et al. |
| 8,278,577 | B2 | 10/2012 | Fujita et al. |

FOREIGN PATENT DOCUMENTS

| | | | |
|---|---|---|---|
| FR | 2 034 118 | A1 | 12/1970 |
| JP | 52-84463 | A | 7/1977 |
| JP | 52-101476 | A | 8/1977 |
| JP | 54-141470 | | 10/1979 |
| JP | 57-171232 | U | 4/1981 |
| JP | 57-63733 | A | 4/1982 |
| JP | 61-38737 | U | 3/1986 |
| JP | 64-19639 | A | 1/1989 |
| JP | 2000-173412 | A | 6/2000 |

(Continued)

OTHER PUBLICATIONS

International Search Report (PCT/ISA/210) issued on Mar. 15, 2011, by the Japanese Patent Office as the International Searching Authority for International Application No. PCT/JP2010/072686.

(Continued)

*Primary Examiner* — Ramon Barrera
(74) *Attorney, Agent, or Firm* — Buchanan Ingersoll & Rooney PC

(57) ABSTRACT

The present invention provides a current switch including a blade-type movable contact configured to extend in a radial direction from a pivoting center and reciprocatingly move such that a free end of the movable contact draws a pivoting track, a fixed contact including energizing members separated from the movable contact and arranged to be opposed to and substantially in parallel to each other on both sides across a pivoting surface of the movable contact and an outer frame configured to cover at least the periphery of the energizing members, a movable arc contact provided in the movable contact, fixed arc contacts provided in the fixed contact, and permanent magnets arranged on the inside of the fixed contact or the movable contact to generate a magnetic field that crosses an arc generated between the movable arc contact and the fixed arc contacts.

13 Claims, 10 Drawing Sheets

(56) References Cited

FOREIGN PATENT DOCUMENTS

| | | | |
|---|---|---|---|
| JP | 2002-42614 | A | 2/2002 |
| JP | 2002-334636 | A | 11/2002 |
| JP | 2005-285674 | A | 10/2005 |
| JP | 2007-335148 | A | 12/2007 |
| JP | 4536152 | B2 | 9/2010 |

OTHER PUBLICATIONS

*Written Opinion (PCT/ISA/237) issued on Mar. 15, 2011, by the Japanese Patent Office as the International Searching Authority for International Application No. PCT/JP2010/072686.

Notice of Rejection issued in the corresponding Japanese Application No. 2011-532379 dated Nov. 18, 2011 with the English Translation of Office Action.

CURRENT SWITCH

FIELD

The present invention relates to a current switch and, more particularly, to a current switch including a blade-type movable contact configured to extend in the radial direction from a pivoting center and reciprocatingly move such that a free end of the movable contact draws a pivoting track and a fixed contact configured to come into contact with and separate from the movable contact within a pivoting range of the movable contact.

BACKGROUND

For example, Patent Literature 1 discloses a current switch including a blade-type movable contact pivotably axially supported and configured to reciprocatingly move such that a free end of the movable contact draws a pivoting track and a fixed contact including an energization member to which the movable contact comes into contact.

Patent Literature 2 discloses an electrode structure of a switch in which an auxiliary fixed electrode is disposed adjacent to an open side of a main fixed electrode, a main contact section that comes into contact with and separates from the main fixed electrode during closing is provided in a blade-type movable electrode capable of coming into contact with and separating from the main fixed electrode, an auxiliary contact section that separates from the auxiliary fixed electrode after the main contact section separates from the main fixed electrode during opening is provided in the movable electrode, and a permanent magnet is disposed to drive and extinct an arc generated between the auxiliary fixed electrode and the auxiliary contact section during the opening using a magnetic flux in a direction crossing the arc.

CITATION LIST

Patent Literature

Patent Literature 1: Japanese Patent No. 4536152
Patent Literature 2: Japanese Patent Application Laid-Open No. S52-84463

SUMMARY

Technical Problem

However, in the electrode structure described in Patent Literature 2, the auxiliary fixed electrode and the permanent magnet are disposed adjacent to the main fixed electrode and as components separate from the main fixed electrode. Therefore, there is a problem in that the number of components increases and the dimensions of the entire switch increase.

The present invention has been devised in view of the above and it is an object of the present invention to provide a current switch that can drive an arc with a permanent magnet to improve current switching performance and can be reduced in dimensions.

Solution to Problem

In order to solve the above problem and in order to attain the above object, a current switch of the present invention includes: a blade-type movable contact configured to extend in a radial direction from a pivoting center and reciprocatingly move such that a free end of the movable contact draws a pivoting track; a fixed contact including energizing members separated from the movable contact and arranged to be opposed to and substantially in parallel to each other on both sides across a pivoting surface of the movable contact and a shielding member configured to cover at least a periphery of the energizing members and shield the periphery of the energizing members from an external electric field and provided with an opening section substantially U-shaped in section into which the movable contact can penetrate; a movable arc contact provided in the movable contact; fixed arc contacts provided in the fixed contact; and a permanent magnet arranged on an inside of the fixed contact or the movable contact to generate a magnetic field that crosses an arc generated between the movable arc contact and the fixed arc contacts during contact and separation of the movable contact and the fixed contact.

Advantageous Effects of Invention

According to the present invention, it is possible to drive an arc with a permanent magnet to improve current switching performance and reduce dimensions.

DESCRIPTION OF EMBODIMENTS

A current switch according to embodiments of the present invention are explained in detail below based on the drawings. The present invention is not limited by the embodiments.

First Embodiment

Figure 1:
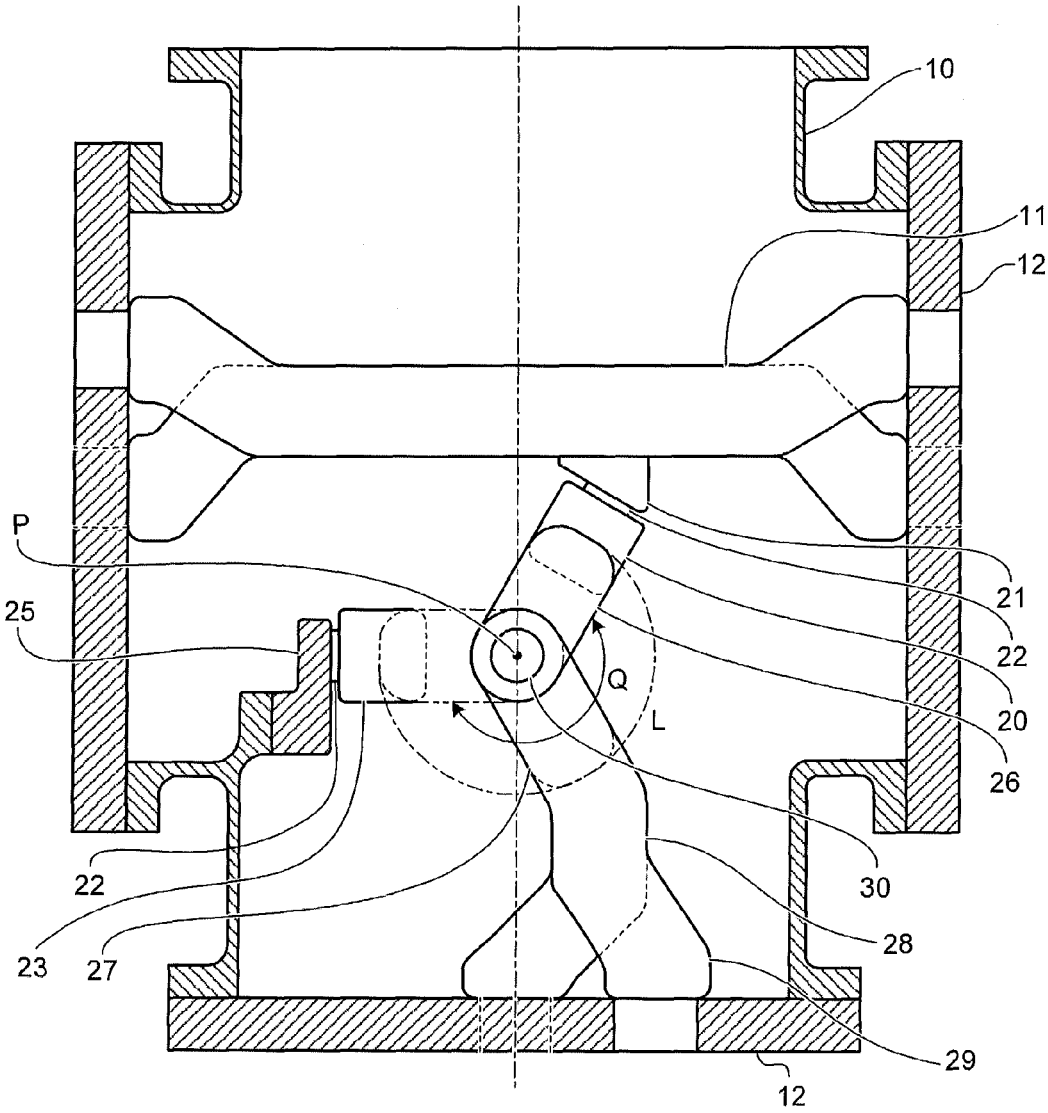
FIG. 1 is a sectional view on a surface extending along a main bus of a current switch according to a first embodiment.
Figure 2:
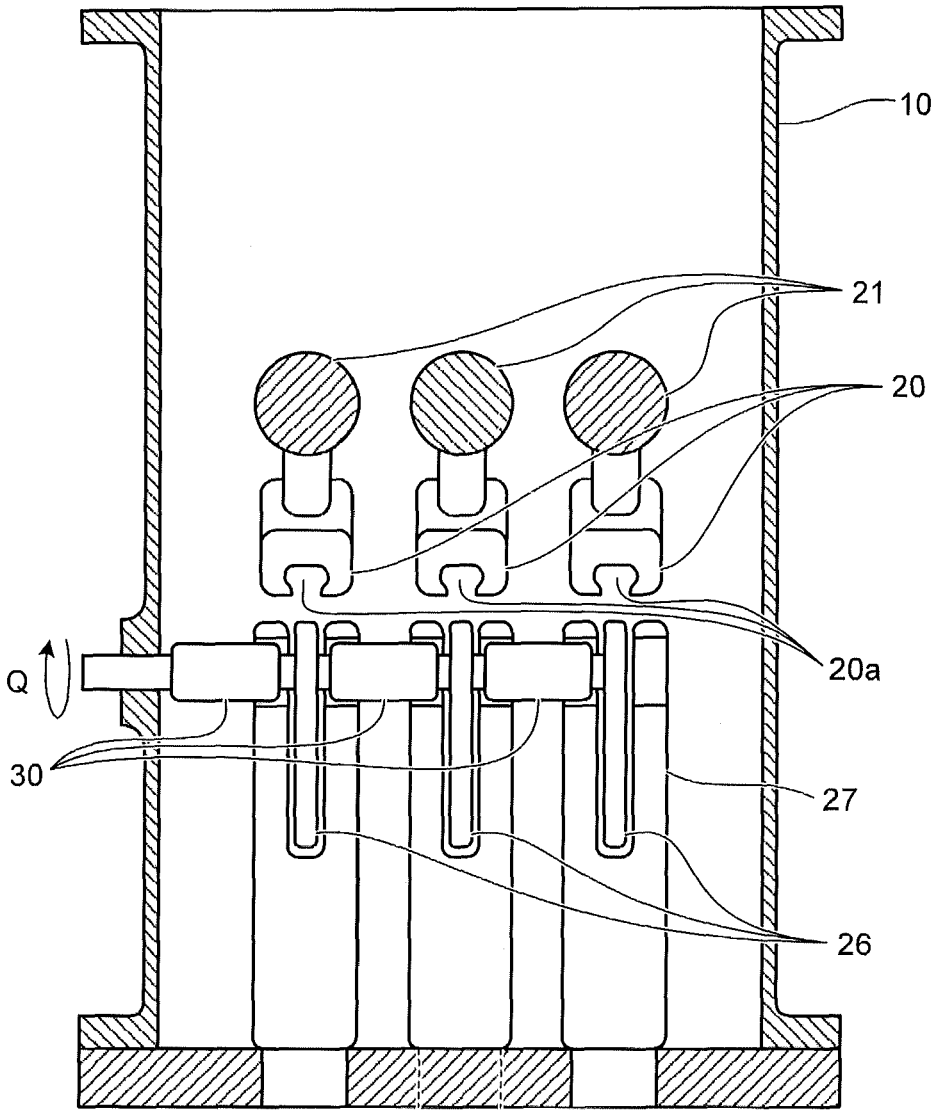
FIG. 2 is a sectional view on a surface extending along an insulated operating shaft of the current switch according to the first embodiment.

FIG. 1 is a sectional view on a surface extending along a main bus of a current switch according to a first embodiment. FIG. 2 is a sectional view on a surface extending along an insulated operating shaft of the current switch. A tank 10 forms a space sealed with an opening section for communicating with other tanks partitioned by an insulated spacer 12. An insulation gas such as a sulfur hexafluoride gas is filled in the sealed space. A three-phase main bus 11 arranged to extend in the horizontal direction is housed in the tank 10. Fixed contacts 20 are disposed in respective phases via a fixed side supporting conductor 21 and a connection conductor 22. Three fixed contacts for grounding 23 are disposed in other places in the tank 10 via a fixed side supporting conductor for grounding 25 and a connection conductor 22.

In still other positions in the tank 10, three movable side supporting conductors 28 supported from the insulated spacer 12 by a spacer connection conductor 29 extend toward the center of the tank 10. As clearly shown in FIG. 2, distal ends of the movable side supporting conductors 28 are respectively formed as slit conductors 27 in a forked shape with slits formed therein. Insulated operating shafts 30 are disposed in the slit conductors 27 to collectively pierce through the three slit conductors 27. The insulated operating shafts 30 are pivotably supported in a state in which the insulated operating shafts 30 electrically insulate the three slit conductors 27 from one another.

Blade-type (plate-like) movable contacts 26 are provided in the respective slit conductors 27 while being supported by the insulated operating shafts 30. The movable contacts 26 is formed in a generally elongated plate shape extending in the radial direction from a pivoting center P. The movable contact 26 pivots with the insulated operating shaft 30 as a pivoting center such that a free end 26*a* of the movable contact 26 draws a pivoting track L. The free end 26 at the distal end is brought into contact with the fixed contact 20 or brought into contact with the fixed contact for grounding 23. As clearly shown in FIG. 1, the movable contact 26 pivots as indicated by an arrow Q in the figure around a complete open-circuit position housed in the slit and reciprocatingly moves between a complete closed-circuit position in contact with the fixed contact 20 and a grounding position in contact with the fixed contact for grounding 23. The fixed contact 20 is arranged on one end side in a pivoting range of the movable contact 26. The fixed contact for grounding 23 is arranged on the other end side of the pivoting range. A rotating angle from the slit conductor 27 to the fixed contact 20 and a rotating angle from the slit conductor 27 to the fixed contact for grounding 23 are set to, for example, the same angle.

The fixed contacts 20 and the fixed contacts for grounding 23 are formed in a generally C-shape (or U-shape) in section in which opening sections 20*a* into which the movable contacts 26 respectively penetrate. Each of the opening sections 20*a* is disposed toward the insulated operating shaft 30 direction. The fixed contact 20 and the fixed contact for grounding 23 are formed in substantially the same structures. The structure of the fixed contact 20 is mainly explained below.

Figure 3:
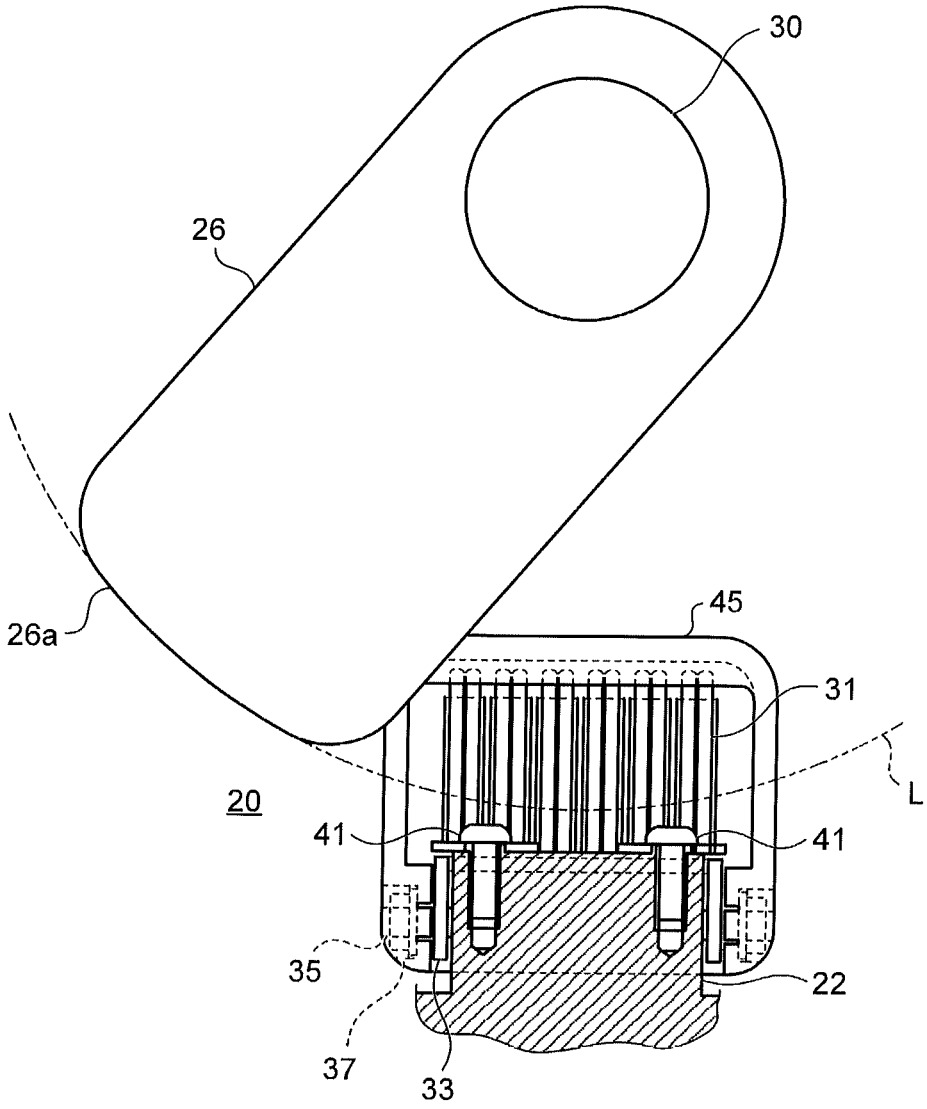
FIG. 3 is a sectional view of a fixed contact on a pivoting surface of a movable contact.
Figure 4:
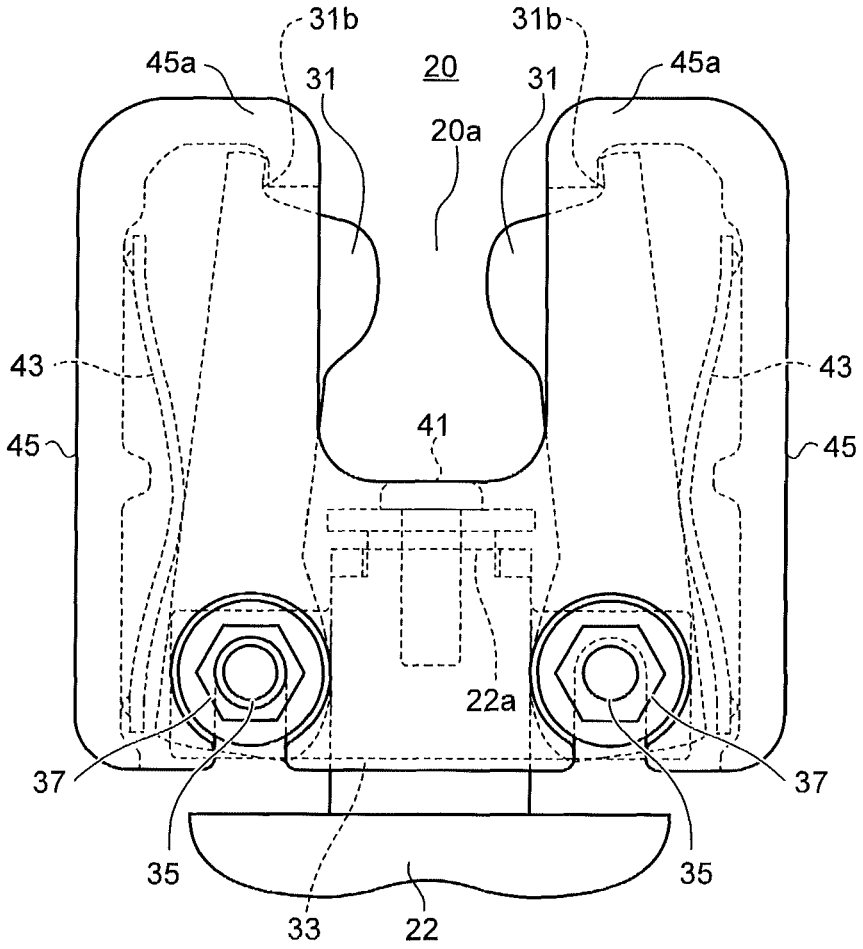
FIG. 4 is a front view of the fixed contact shown in FIG. 3.

FIG. 3 is a sectional view of the fixed contact on a surface including the pivoting track of the free end of the movable contact. FIG. 4 is a front view of the fixed contact shown in FIG. 3 and is a diagram of the fixed contact viewed from a reciprocating moving direction of the movable contact. The fixed contact 20 includes, for example, six pairs of energizing members 31 formed in pairs and arranged to be opposed to one another substantially in parallel with distal ends thereof faced to the opening section 20*a*, a supporting frame 33 that tiltably supports base sections of the energizing members 31, a leaf sprig 43 functioning as a pressuring member that urges the energizing members 31 in a direction in which the energizing members 31 approach each other, and an outer frame 45 that covers the peripheries of the energizing members 31, the supporting frame 33, and the leaf spring 43 and shields the energizing members 31, the supporting frame 33, and the leaf spring 43 from an external electric field.

The energizing members 31 are arranged in an inverted V shape to be opposed to one another while holding a pivoting surface of the movable contact. Six pairs of the inverted V shapes are provided side by side a predetermined space apart from one another in a pivoting track L direction of the movable contact 26. The six pairs of energizing members 31 respectively forming rows are collectively supported by a supporting bar 35 inserted through a through-hole drilled in the base section. The supporting bar 35 is loosely fit in through-holes of the energizing members 31 and fastened to the supporting frame 33 by a fastening member 37. With this structure, the energizing members 31 are tiltably supported such that a separation space (opening width) of distal ends of the energizing members 31 changes in size.

The outer frame 45 is made of, for example, a casting having a large degree of freedom of a shape and effective for blocking an electric field. The outer frame 45 forms an outer shell of the fixed contact 20. The outer frame 45 is formed in a generally box shape that covers the peripheries of the energizing members 31, the supporting frame 33, and the leaf spring 43. The opening sections 20*a* into which the blade-type movable contact 26 intrudes are formed in positions corresponding to the distal end spaces of the energizing members 31 formed in pairs and arranged substantially in parallel to be opposed to each other. Two sets of slip-off preventing members 41 formed by screws and washers are inserted from the opening sections 20*a* of the outer frame 45 and fastened to a projecting section 22*a* of the connection conductor 22. Distal end opposed edge sections facing the opening sections 20*a* are bent in a generally L-shape in section to the inner side. Distal end sections 45*a* bent in the generally L-shape in section formed as engaging sections are engaged with cutouts 31*b* formed at the distal ends of the energizing members 31, which are sections to be engaged. Consequently, the outer frame 45 overcomes the urging force of the leaf spring 43 and keeps the opening width of the distal ends of the energizing members 31 at predetermined breadth.

As clearly shown in FIG. 3, the free end 26*a* of the movable contact 26 is formed in, for example, a shape extending along the pivoting track L of the movable contact 26. By forming the free end 26*a* in such a shape, it is possible to reduce an electric field of the free end 26*a* without increasing a pivoting range when the movable contact 26 pivots in voltage applied state.

The current switch according to this embodiment further includes a movable arc contact, fixed arc contacts, and permanent magnets in addition to the components shown in FIGS. 3 and 4.

Figure 5:
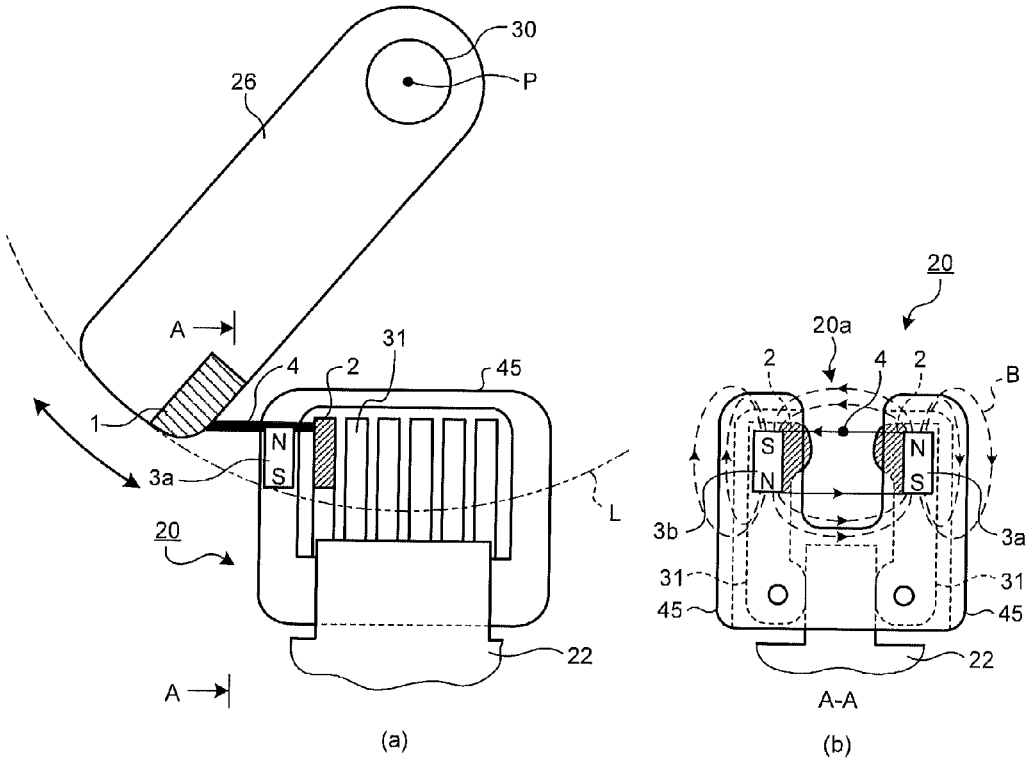
FIG. 5 is a diagram of an arrangement configuration of a movable arc contact, fixed arc contacts, and permanent magnets in the current switch according to the first embodiment.

FIG. 5 is a diagram of an arrangement configuration of the movable arc contact, the fixed arc contacts, and the permanent magnets in the current switch according to this embodiment. (a) is a configuration diagram equivalent to FIG. 3 and (b) is an A-A arrow view of (a). In FIG. 5, components same as the components shown in FIGS. 3 and 4 are denoted by the same reference numerals and signs. In FIG. 5, a part of the components shown in FIGS. 3 and 4 are omitted to mainly show the arrangement configuration of the movable arc contact, the fixed arc contacts, and the permanent magnets.

As shown in FIG. 5, a movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact: 26 on a side on which the movable contact 26 is in contact with the fixed contact 20 to the end during opening. The movable arc contact 1 is provided to cover a part of each of both surfaces of the movable arc contact 1 parallel to the pivoting surface and a part of an end face between both the surfaces. The pivoting surface is a surface including the pivoting track L.

Fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 5, an arrangement configuration halfway in an opening action of the movable contact 26 is shown. A state in which an arc 4 is generated between the movable arc contact 1 and the fixed arc contacts 2 is also shown.

Further, for example, a pair of permanent magnets 3*a* and 3*b* is arranged on the inner side of the outer frame 45. Specifically, both the permanent magnets 3*a* and 3*b* are arranged such that magnetizing directions of the permanent magnets 3*a* and 3*b* are substantially parallel to the pivoting surface of the movable contact 26 and substantially orthogonal to the reciprocating moving direction of the movable contact 26.

When viewed from the pivoting center P, the permanent magnets 3*a* and 3*b* are arranged further on the outer sides in the radial direction than contact and separation points of the movable arc contact 1 and the fixed arc contacts 2. That is, the permanent magnets 3*a* and 3*b* are arranged further on the substantial outer sides in the radial direction than the position of the arc 4 generated between the movable arc contact 1 and the fixed arc contacts 2 during opening of the movable contact 26.

The permanent magnets 3*a* and 3*b* are arranged to be opposed to each other across the opening section 20*a*. That is, the permanent magnets 3*a* and 3*b* are arranged to be opposed to each other on both sides across the pivoting surface.

The permanent magnets 3*a* and 3*b* are respectively housed, for example, in not-shown cases and the cases are attached to the inner side of the outer frame 45. Specifically, the permanent magnets 3*a* and 3*b* are attached to, for example, the inner side of the outer frame 45 on the movable contact 26 side in the reciprocating moving direction of the movable contact 26. That is, the permanent magnets 3*a* and 3*b* are respectively arranged between the fixed arc contacts 2 and the outer frame 45 and arranged in the vicinity of the contact and separation points of the movable arc contact 1 and the fixed arc contacts 2. Each of the permanent magnets 3*a* and 3*b* is, for example, columnar.

The magnetizing directions of the permanent magnets 3*a* and 3*b* are, for example, opposite to each other. That is, for example, the N pole of the permanent magnet 3*a* and the S pole of the permanent magnet 3*b* are opposed to each other and the S pole of the permanent magnet 3*a* and the N pole of the permanent magnet 3*b* are opposed to each other across the pivoting surface. Therefore, in the generating position of the arc 4, the direction of magnetic flux density B is a direction in which the permanent magnets 3*a* and 3*b* are opposed to each other and is substantially orthogonal to the arc 4 substantially parallel to the reciprocating moving direction of the movable contact 26 (FIG. 5(*b*)).

An operation in this embodiment is explained. For example, an opening operation is explained below. However, a closing operation is the same. In a closed-circuit state, the movable contact 26 is in contact with the energizing members 31. However, during opening, first, the movable contact 26 and the energizing members 31 separate from each other and, subsequently, the movable arc contact 1 and the fixed arc contacts 2 separate from each other. Therefore, the arc 4 is generated between the movable arc contact 1 and the fixed arc contacts 2. However, the magnetic flux density B generated in the direction between the permanent magnets 3*a* and 3*b* arranged in the outer frame 45 is generated in a direction substantially orthogonal to the arc 4. Therefore, simultaneously with the generation, the arc 4 is subjected to a Lorentz force in a direction orthogonal to both of the magnetic flux density B and an extending direction of the arc 4 (the reciprocating moving direction) and driven by the magnetic flux density B. The arc 4 is effectively cooled and extinguished by an arc-extinguishing insulation gas.

As explained above, according to this embodiment, the arc 4 can be driven and quickly extinguished in a gas space by the permanent magnets 3*a* and 3*b*. Therefore, current switching performance is improved.

Further, according to this embodiment, the permanent magnets 3*a* and 3*b* are arranged on the inner side of the outer frame 45, i.e., on the inside of the fixed contact 20. Therefore, compared with a configuration in which the permanent magnets 3*a* and 3*b* are provided on the outside of the fixed contact 20, it is also possible to reduce the dimensions of the entire current switch. In particular, the permanent magnets 3*a* and 3*b* can be efficiently arranged making use of internal spaces between the energizing members 31 and the outer frame 45.

According to this embodiment, the pair of permanent magnets 3*a* and 3*b* is provided in the vicinity of the arc 4 across the pivoting surface such that different polarities of the permanent magnets 3*a* and 3*b* are opposed to each other. Therefore, it is possible to increase the magnetic flux density B orthogonal to the extending direction of the arc 4 (the reciprocating moving direction) in the vicinity of the arc 4. The extinction of the arc 4 is further facilitated.

In this embodiment, when viewed from the pivoting center P, the permanent magnets 3*a* and 3*b* are arranged further on the outer sides in the radial direction than the contact and separation points of the movable arc contact 1 and the fixed arc contacts 2. Therefore, the structure of the fixed contact 20 is made appropriate without hindering the pivoting range of the movable contact 26.

The fixed arc contacts 2 are provided, for example, at the distal ends of the energizing members 31. However, the fixed arc contacts 2 are not limited to this. For example, the fixed arc contacts 2 can also be provided in the outer frame 45 to be separate from the energizing members 31 and adjacent to the energizing members 31. That is, the fixed arc contacts 2 can be provided in the energizing members 31 or the vicinity of the energizing members 31.

Second Embodiment

A current switch according to a second embodiment further includes a movable arc contact, fixed arc contacts, and permanent magnets in addition to the components shown in FIGS. 3 and 4.

Figure 6:
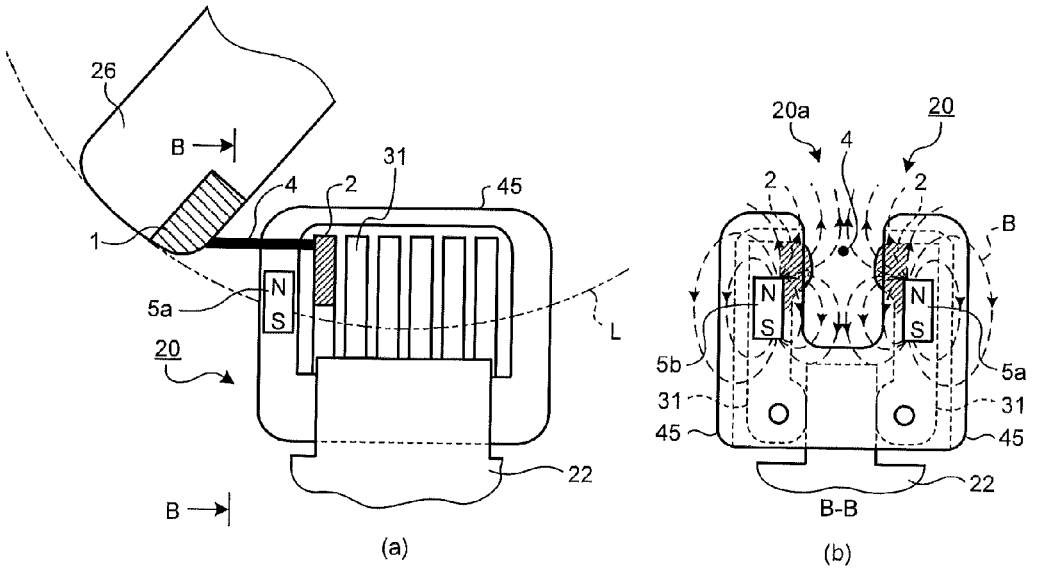
FIG. 6 is a diagram of an arrangement configuration of a movable arc contact, fixed arc contacts, and permanent magnets in a current switch according to a second embodiment.

FIG. 6 is a diagram of an arrangement configuration of the movable arc contact, the fixed arc contacts, and the permanent magnets in the current switch according to this embodiment. (a) is a configuration diagram equivalent to FIG. 3 and (b) is a B-B arrow view of (a). In FIG. 6, components same as the components shown in FIGS. 3 and 4 are denoted by the same reference numerals and signs. In FIG. 6, a part of the components shown in FIGS. 3 and 4 are omitted to mainly show the arrangement configuration of the movable arc contact, the fixed arc contacts, and the permanent magnets.

As shown in FIG. 6, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 6, an arrangement configuration halfway in an opening action of the movable contact 26 is shown. A state in which the arc 4 is generated between the movable arc contact 1 and the fixed arc contacts 2 is also shown.

Further, for example, a pair of permanent magnets 5*a* and 5*b* is arranged on the inner side of the outer frame 45. Specifically, both the permanent magnets 5*a* and 5*b* are arranged such that magnetizing directions of the permanent magnets 5*a* and 5*b* are substantially parallel to the pivoting surface of the movable contact 26 and substantially orthogonal to the reciprocating moving direction of the movable contact 26.

When viewed from the pivoting center P, the permanent magnets 5*a* and 5*b* are arranged further on the outer sides in the radial direction than contact and separation points of the movable arc contact 1 and the fixed arc contacts 2. That is, the permanent magnets 5*a* and 5*b* are arranged further on the substantial outer sides in the radial direction than the position of the arc 4 generated between the movable arc contact 1 and the fixed arc contacts 2 during opening of the movable contact 26.

The permanent magnets 5*a* and 5*b* are arranged to be opposed to each other across the opening section 20*a*. That is, the permanent magnets 5*a* and 5*b* are arranged to be opposed to each other on both sides across the pivoting surface.

The permanent magnets 5*a* and 5*b* are respectively housed, for example, in not-shown cases and the cases are attached to the inner side of the outer frame 45. Specifically, the permanent magnets 5*a* and 5*b* are attached to, for example, the inner side of the outer frame 45 on the movable contact 26 side in the reciprocating moving direction of the movable contact 26. That is, the permanent magnets 5*a* and 5*b* are respectively arranged between the fixed arc contacts 2 and the outer frame 45 and arranged in the vicinity of the contact and separation points of the movable arc contact 1 and the fixed arc contacts 2. Each of the permanent magnets 5*a* and 5*b* is, for example, columnar.

The magnetizing directions of the permanent magnets 5*a* and 5*b* are, for example, the same each other. That is, for example, the N pole of the permanent magnet 5*a* and the N pole of the permanent magnet 5*b* are opposed to each other and the S pole of the permanent magnet 5*a* and the S pole of the permanent magnet 5*b* are opposed to each other across the pivoting surface. Therefore, in the generating position of the arc 4, the direction of magnetic flux density B is substantially parallel to the magnetizing directions of the permanent magnets 5*a* and 5*b* and substantially orthogonal the arc 4 substantially parallel to the reciprocating moving direction of the movable contact 26 (FIG. 6(*b*)).

An operation in this embodiment is the same as the operation in the first embodiment. The arc 4 is generated between the movable arc contact 1 and the fixed arc contacts 2. However, the magnetic flux density B of the permanent magnets 5*a* and 5*b* arranged in the outer frame 45 is generated in the direction substantially orthogonal to the arc 4. Therefore, simultaneously with the generation, the arc 4 is subjected to a Lorentz force in a direction orthogonal to both of the magnetic flux density B and an extending direction of the arc 4 (the reciprocating moving direction) and driven by the magnetic flux density B. The arc 4 is effectively cooled and extinguished by an arc-extinguishing insulation gas. In the case of this embodiment, the magnetic flux density B generated in the direction between the same polarities of the permanent magnets 5*a* and 5*b* is small because of the influence of repulsive forces of the permanent magnets 5*a* and 5*b*. Therefore, the permanent magnets 5*a* and 5*b* are arranged to shift further to the outer sides viewed from the pivoting center than the contact and separation points of the movable arc contact 1 and the fixed arc contacts 2. The magnetic flux density B in the extending direction of the movable contact 26 and the arc are set substantially orthogonal to each other. As a result, an effect same as the effect in the first embodiment is attained. The fixed arc contacts 2 can be provided in the vicinity of the energizing members 31 as well.

Third Embodiment

A current switch according to a third embodiment further includes a movable arc contact, fixed arc contacts, and permanent magnets in addition to the components shown in FIGS. 3 and 4.

Figure 7:
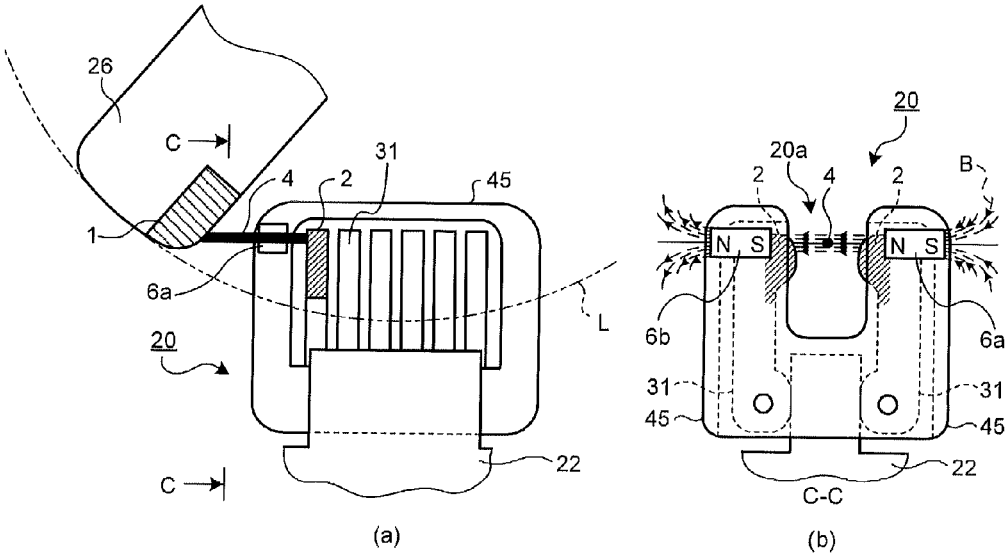
FIG. 7 is a diagram of an arrangement configuration of a movable arc contact, fixed arc contacts, and permanent magnets in a current switch according to a third embodiment.

FIG. 7 is a diagram of an arrangement configuration of the movable arc contact, the fixed arc contacts, and the permanent magnets in the current switch according to this embodiment. (a) is a configuration diagram equivalent to FIG. 3 and (b) is a C-C arrow view of (a). In FIG. 7, components same as the components shown in FIGS. 3 and 4 are denoted by the same reference numerals and signs. In FIG. 7, a part of the components shown in FIGS. 3 and 4 are omitted to mainly show the arrangement configuration of the movable arc contact, the fixed arc contacts, and the permanent magnets.

As shown in FIG. 7, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 7, an arrangement configuration halfway in an opening action of the movable contact 26 is shown. A state in which the arc 4 is generated between the movable arc contact 1 and the fixed arc contacts 2 is also shown.

Further, for example, a pair of permanent magnets 6*a* and 6*b* is arranged on the inner side of the outer frame 45. Specifically, both the permanent magnets 6*a* and 6*b* are arranged such that magnetizing directions of the permanent magnets 6*a* and 6*b* are substantially orthogonal to the pivoting surface of the movable contact 26.

When viewed from the pivoting center P, the permanent magnets 6*a* and 6*b* are arranged, for example, in substantially the same positions in the radial direction as contact and separation points of the movable arc contact 1 and the fixed arc contacts 2. That is, the permanent magnets 6*a* and 6*b* are arranged in substantially the same positions in the radial direction as the position of the arc 4 generated between the movable arc contact 1 and the fixed arc contacts 2 during opening of the movable contact 26.

The permanent magnets 6*a* and 6*b* are arranged to be opposed to each other across the opening section 20*a*. That is, the permanent magnets 6*a* and 6*b* are arranged to be opposed to each other on both sides across the pivoting surface. Further, magnetizing directions of the respective permanent magnets 6*a* and 6*b* are located, for example, on substantially the same straight lines.

The permanent magnets 6*a* and 6*b* are respectively housed, for example, in not-shown cases and the cases are attached to the inner side of the outer frame 45.

Specifically, the permanent magnets 6*a* and 6*b* are attached to, for example, the inner side of the outer frame 45 on the movable contact 26 side in the reciprocating moving direction of the movable contact 26. That is, the permanent magnets 6*a* and 6*b* are respectively arranged between the fixed arc contacts 2 and the outer frame 45 and arranged in the vicinity of the contact and separation points of the movable arc contact 1 and the fixed arc contacts 2. Each of the permanent magnets 6*a* and 6*b* is, for example, columnar.

The permanent magnets 6*a* and 6*b* are arranged such that different polarities are opposed to each other. That is, for example, the N pole of the permanent magnet 6*a* and the S pole of the permanent magnet 6*b* are opposed to each other across the pivoting surface. Therefore, in the generating position of the arc 4, the direction of magnetic flux density B is substantially parallel to the magnetizing directions of the permanent magnets 6*a* and 6*b* and substantially orthogonal to the arc 4 substantially parallel to the reciprocating moving direction of the movable contact 26 (FIG. 7(*b*)).

An operation in this embodiment is explained. For example, an opening operation is explained below. However, a closing operation is the same. In a closed-circuit state, the movable contact 26 is in contact with the energizing members 31. However, during opening, first, the movable contact 26 and the energizing members 31 separate from each other and, subsequently, the movable arc contact 1 and the fixed arc contacts 2 separate from each other. Therefore, the arc 4 is generated between the movable arc contact 1 and the fixed arc contacts 2. However, the magnetic flux density B generated in the direction between the permanent magnets 6*a* and 6*b* arranged in the outer frame 45 is generated in a direction substantially orthogonal to the arc 4. Therefore, simultaneously with the generation, the arc 4 is subjected to a Lorentz force in a direction orthogonal to both of the magnetic flux density B and an extending direction of the arc 4 (the reciprocating moving direction) and driven by the magnetic flux density B. The arc 4 is effectively cooled and extinguished by an arc-extinguishing insulation gas.

As explained above, according to this embodiment, the arc 4 can be driven and quickly extinguished in a gas space by the permanent magnets 6*a* and 6*b*. Therefore, current switching performance is improved.

Further, according to this embodiment, the permanent magnets 6*a* and 6*b* are arranged on the inner side of the outer frame 45, i.e., on the inside of the fixed contact 20. Therefore, compared with a configuration in which the permanent magnets 6*a* and 6*b* are provided on the outside of the fixed contact 20, it is also possible to reduce the dimensions of the entire current switch. In particular, the permanent magnets 6*a* and 6*b* can be efficiently arranged making use of internal spaces between the energizing members 31 and the outer frame 45.

According to this embodiment, the pair of permanent magnets 6*a* and 6*b* is provided in the vicinity of the arc 4 across the pivoting surface such that different polarities of the permanent magnets 6*a* and 6*b* are opposed to each other. Therefore, it is possible to increase the magnetic flux density B orthogonal to the extending direction of the arc 4 (the reciprocating moving direction) in the vicinity of the arc 4. The extinction of the arc 4 is further facilitated. One of the permanent magnets 6*a* and 6*b* can be arranged, for example, on one side of the pivoting surface.

The fixed arc contacts 2 are provided, for example, at the distal ends of the energizing members 31. However, the fixed arc contacts 2 can also be provided in the vicinity of the energizing members 31.

Fourth Embodiment

A current switch according to a second embodiment further includes a movable arc contact, fixed arc contacts, and permanent magnets in addition to the components shown in FIGS. 3 and 4.

Figure 8:
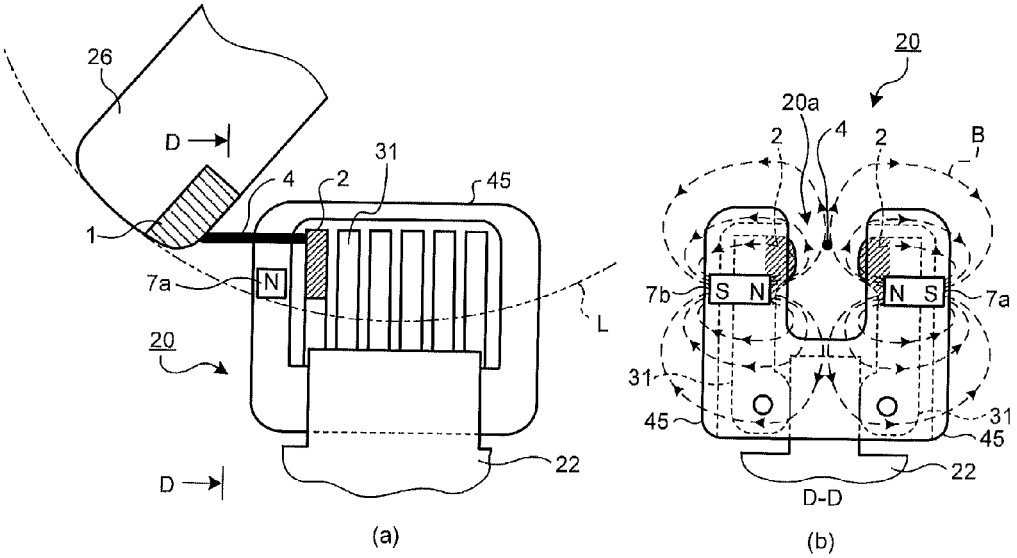
FIG. 8 is a diagram of an arrangement configuration of a movable arc contact, fixed arc contacts, and permanent magnets in a current switch according to a fourth embodiment.

FIG. 8 is a diagram of an arrangement configuration of the movable arc contact, the fixed arc contacts, and the permanent magnets in the current switch according to this embodiment. (a) is a configuration diagram equivalent to FIG. 3 and (b) is a D-D arrow view of (a). In FIG. 8, components same as the components shown in FIGS. 3 and 4 are denoted by the same reference numerals and signs. In FIG. 8, a part of the components shown in FIGS. 3 and 4 are omitted to mainly show the arrangement configuration of the movable arc contact, the fixed arc contacts, and the permanent magnets.

As shown in FIG. 8, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20.

Specifically, the fixed arc contacts 2 are provided at the distal ends of a pair of energizing members 31 arranged closest to the movable contact 26 side in the reciprocating moving direction of the movable contact 26. In FIG. 8, an arrangement configuration halfway in an opening action of the movable contact 26 is shown. A state in which the arc 4 is generated between the movable arc contact 1 and the fixed arc contacts 2 is also shown.

Further, for example, a pair of permanent magnets 7*a* and 7*b* is arranged on the inner side of the outer frame 45. Specifically, both the permanent magnets 7*a* and 7*b* are arranged such that magnetizing directions of the permanent magnets 7*a* and 7*b* are substantially orthogonal to the pivoting surface of the movable contact 26.

When viewed from the pivoting center P, the permanent magnets 7*a* and 7*b* are arranged, for example, further on the outer sides in the radial direction than contact and separation points of the movable arc contact 1 and the fixed arc contacts 2. That is, the permanent magnets 7*a* and 7*b* are arranged further on the substantial outer sides in the radial direction than the position of the arc 4 generated between the movable arc contact 1 and the fixed arc contacts 2 during opening of the movable contact 26.

The permanent magnets 7*a* and 7*b* are arranged to be opposed to each other across the opening section 20*a*. That is, the permanent magnets 7*a* and 7*b* are arranged to be opposed to each other on both sides across the pivoting surface. Further, magnetizing directions of the respective permanent magnets 7*a* and 7*b* are located, for example, on substantially the same straight lines.

The permanent magnets 7*a* and 7*b* are respectively housed, for example, in not-shown cases and the cases are attached to the inner side of the outer frame 45. Specifically, the permanent magnets 7*a* and 7*b* are attached to, for example, the inner side of the outer frame 45 on the movable contact 26 side in the reciprocating moving direction of the movable contact 26. That is, the permanent magnets 7*a* and 7*b* are respectively arranged between the fixed arc contacts 2 and the outer frame 45 and arranged in the vicinity of the contact and separation points of the movable arc contact 1 and the fixed arc contacts 2. Each of the permanent magnets 7*a* and 7*b* is, for example, columnar.

The magnetizing directions of the permanent magnets 7*a* and 7*b* are, for example, the same each other. That is, for example, the N pole of the permanent magnet 7*a* and the N pole of the permanent magnet 7*b* are opposed to each other. Therefore, in the generating position of the arc 4, the direction of magnetic flux density B is substantially orthogonal to the magnetizing directions of the permanent magnets 7*a* and 7*b* and substantially orthogonal to the arc 4 substantially parallel to the reciprocating moving direction of the movable contact 26 (FIG. 8(*b*)).

An operation in this embodiment is the same as the operation in the third embodiment. The arc 4 is generated between the movable arc contact 1 and the fixed arc contacts 2. However, the magnetic flux density B of the permanent magnets 7*a* and 7*b* arranged in the outer frame 45 is generated in the direction substantially orthogonal to the arc 4. Therefore, simultaneously with the generation, the arc 4 is subjected to a Lorentz force in a direction orthogonal to both of the magnetic flux density B and an extending direction of the arc 4 (the reciprocating moving direction) and driven by the magnetic flux density B. The arc 4 is effectively cooled and extinguished by an arc-extinguishing insulation gas. In the case of this embodiment, the magnetic flux density B generated in the direction between the same polarities of the permanent magnets 7*a* and 7*b* is small because of the influence of repulsive forces of the permanent magnets 7*a* and 7*b*. Therefore, the permanent magnets 7*a* and 7*b* are arranged to shift further to the outer sides viewed from the pivoting center than the contact and separation points of the movable arc contact 1 and the fixed arc contacts 2. The magnetic flux density B in the extending direction of the movable contact 26 and the arc are set substantially orthogonal to each other. As a result, an effect same as the effect in the third embodiment is attained.

When viewed from the pivoting center P, the permanent magnets 7*a* and 7*b* can be arranged, for example, further on the inner sides in the radial direction than the contact and separation points of the movable arm contact 1 and the fixed arc contacts 2 as well. In this case, the permanent magnets 7*a* and 7*b* are arranged further on the inner sides in the radial direction than the position of the arc 4 generated between the movable arc contact 1 and the fixed arc contacts 2 during opening of the movable contact 26. The arc 4 is driven making use of the magnetic flux density B downward in FIG. 8(*b*) in the magnetic flux density B generated between the permanent magnets 7*a* and 7*b*.

The fixed arc contacts 2 can be provided in the vicinity of the energizing members 31 as well.

Fifth Embodiment

A current switch according to a fifth embodiment further includes a movable arc contact, fixed arc contacts, and a permanent magnet in addition to the components shown in FIGS. 3 and 4.

Figure 9:
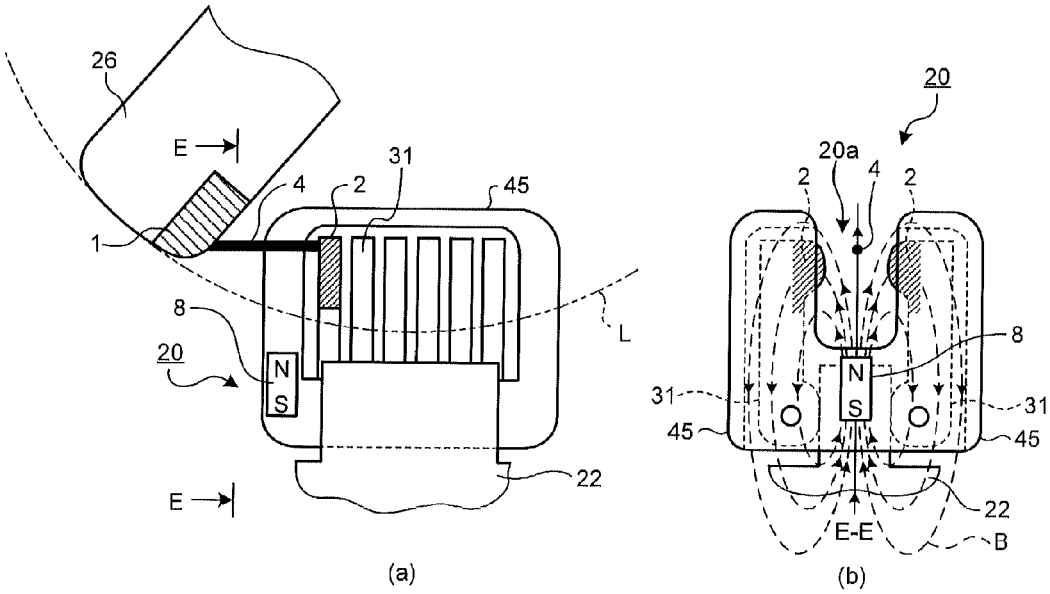
FIG. 9 is a diagram of an arrangement configuration of a movable arc contact, fixed arc contacts, and a permanent magnet in a current switch according to a fifth embodiment.

FIG. 9 is a diagram of an arrangement configuration of the movable arc contact, the fixed arc contacts, and the permanent magnet in the current switch according to this embodiment. (a) is a configuration diagram equivalent to FIG. 3 and (b) is an E-E arrow view of (a). In FIG. 9, components same as the components shown in FIGS. 3 and 4 are denoted by the same reference numerals and signs. In FIG. 9, a part of the components shown in FIGS. 3 and 4 are omitted to mainly show the arrangement configuration of the movable arc contact, the fixed arc contacts, and the permanent magnet.

As shown in FIG. 9, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 9, an arrangement configuration halfway in an opening action of the movable contact 26 is shown. A state in which the arc 4 is generated between the movable arc contact 1 and the fixed arc contacts 2 is also shown.

Further, for example, a permanent magnet 8 is arranged on the inner side of the outer frame 45. Specifically, the permanent magnet 8 is arranged such that a magnetizing direction of the permanent magnet 8 is substantially parallel to the pivoting surface of the movable contact 26 and substantially orthogonal to the reciprocating moving direction of the movable contact 26.

When viewed from the pivoting center P, the permanent magnet 8 is arranged further on the outer side in the radial direction than contact and separation points of the movable arc contact 1 and the fixed arc contacts 2. That is, the permanent magnet 8 is arranged further on substantially the outer side in the radial direction than the position of the arc 4 generated between the movable arc contact 1 and the fixed arc contacts 2 during opening of the movable contact 26.

The permanent magnet 8 is arranged substantially on the pivoting surface (FIG. 9(*b*)). That is, the permanent magnet 8 is arranged substantially in the center in an opposing direction of the energizing members 31 arranged to be opposed to each other across the opening section 20*a*. Further, when viewed from the pivoting center P, the permanent magnet 8 is located further on the outer side in the radial direction than the pivoting track L.

The permanent magnet 8 is housed, for example, in, a not-shown case and the case is attached to the inner side of the outer frame 45. Specifically, the permanent magnet 8 is attached to, for example, the inner side of the outer frame 45 on the movable contact 26 side in the reciprocating moving direction of the movable contact 26. That is, the permanent magnet 8 is arranged between the fixed arc contacts 2 and the outer frame 45 and arranged in the vicinity of the contact and separation points of the movable arc contact 1 and the fixed arc contacts 2. The permanent magnet 8 is, for example, columnar.

As shown in FIG. 9(*b*), in the generating position of the arc 4, the direction of the magnetic flux density B of the permanent magnet 8 is substantially parallel to the magnetizing direction of the permanent magnet 8 and substantially orthogonal to the arc 4 substantially parallel to the reciprocating moving direction of the movable contact 26.

An operation in this embodiment is the same as the operation in the first embodiment. The arc 4 is generated between the movable arc contact 1 and the fixed arc contacts 2. However, the magnetic flux density B of the permanent magnet 8 arranged in the outer frame 45 is generated in the direction substantially orthogonal to the arc 4. Therefore, simultaneously with the generation, the arc 4 is subjected to a Lorentz force in a direction orthogonal to both of the magnetic flux density B and an extending direction of the arc 4 (the reciprocating moving direction) and driven by the magnetic flux density B. The arc 4 is effectively cooled and extinguished by an arc-extinguishing insulation gas.

As explained above, according to this embodiment, the arc 4 can be driven and quickly extinguished in a gas space by the permanent magnet 8. Therefore, current switching performance is improved.

Further, according to this embodiment, the permanent magnet 8 is arranged on the inner side of the outer frame 45, i.e., on the inside of the fixed contact 20. Therefore, compared with a configuration in which the permanent magnet 8 is provided on the outside of the fixed contact 20, it is also possible to reduce the dimensions of the entire current switch. In particular, the permanent magnet 8 can be efficiently arranged making use of an internal space between the energizing members 31 and the outer frame 45.

In this embodiment, when viewed from the pivoting center P, the permanent magnet 8 is arranged further on the outer sides in the radial direction than the contact and separation points of the movable arc contact 1 and the fixed arc contacts 2. Therefore, it is possible to increase the magnetic flux density B orthogonal to the extending direction of the arc 4 (the reciprocating moving direction).

The fixed arc contacts 2 can be provided in the vicinity of the energizing members 31 as well.

Sixth Embodiment

A current switch according to a sixth embodiment further includes a movable arc contact, fixed arc contacts, and a permanent magnet in addition to the components shown in FIGS. 3 and 4.

Figure 10:
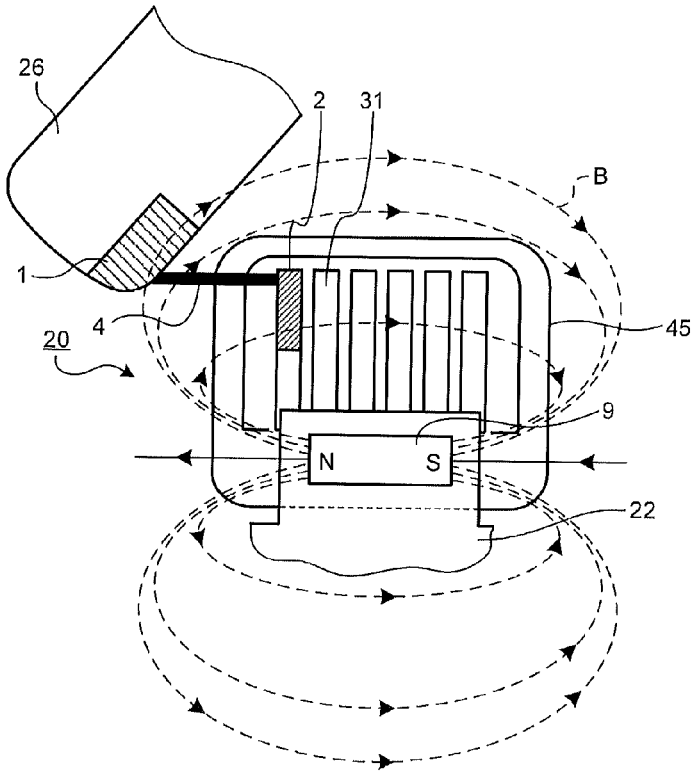
FIG. 10 is a diagram of an arrangement configuration of a movable arc contact, fixed arc contacts, and a permanent magnet in a current switch according to a sixth embodiment.

FIG. 10 is a diagram of an arrangement configuration of the movable arc contact, the fixed arc contacts, and the permanent magnet in the current switch according to this embodiment. FIG. 10 is a configuration diagram equivalent to FIG. 3. In FIG. 10, components same as the components shown in FIG. 3 are denoted by the same reference numerals and signs. In FIG. 10, a part of the components shown in FIG. 3 are omitted to mainly show the arrangement configuration of the movable arc contact, the fixed arc contacts, and the permanent magnet.

As shown in FIG. 10, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 10, an arrangement configuration halfway in an opening action of the movable contact 26 is shown. A state in which the arc 4 is generated between the movable arc contact 1 and the fixed arc contacts 2 is also shown.

Further, for example, a columnar permanent magnet 9 is arranged on the inner side of the outer frame 45. Specifically, the permanent magnet 9 is arranged such that a magnetizing direction of the permanent magnet 9 is substantially parallel to the reciprocating moving direction of the movable contact 26.

When viewed from the pivoting center P, the permanent magnet 9 is arranged, for example, further on the outer side in the radial direction than contact and separation points of the movable arc contact 1 and the fixed arc contacts 2. That is, the permanent magnet 9 is arranged further on substantially the outer side in the radial direction than the position of the arc 4 generated between the movable arc contact 1 and the fixed arc contacts 2 during opening of the movable contact 26.

For example, one end in a magnetizing direction of the permanent magnet 9 is arranged in the vicinity of the contact and separation points of the movable arc contact 1 and the fixed arc contact 2. In an example shown in the figure, one end on the N pole side of the permanent magnet 9 is arranged in the vicinity of the contact and separation points of the movable arc contact 1 and the fixed arc contact 2. Specifically, the permanent magnet 9 is arranged, for example, on the inside of the connection conductor 22. When viewed from the pivoting center P, the one end on the N pole side of the permanent magnet 9 is arranged on the outer side in the radial direction of the fixed arc contacts 2 and arranged in the vicinity of the contact and separation points of the movable arc contact 1 and the fixed arc contacts 2. The permanent magnet 9 can be arranged to be located, for example, substantially on the pivoting surface.

As shown in FIG. 10, in the generating position of the arc 4, the direction of the magnetic flux density B of the permanent magnet 9 is substantially parallel to the magnetizing direction of the permanent magnet 9 and substantially orthogonal to the arc 4 substantially parallel to the reciprocating moving direction of the movable contact 26.

An operation in this embodiment is the same as the operation in the first embodiment. The arc 4 is generated between the movable arc contact 1 and the fixed arc contacts 2. However, the magnetic flux density B of the permanent magnet 9 arranged in the outer frame 45 is generated in the direction substantially orthogonal to an extending direction of the arc 4 (the reciprocating moving direction). Therefore, simultaneously with the generation, the arc 4 is subjected to a Lorentz force in a direction orthogonal to both of the magnetic flux density B and the extending direction of the arc 4 (the reciprocating moving direction) and driven by the magnetic flux density B. The arc 4 is effectively cooled and extinguished by an arc-extinguishing insulation gas.

As explained above, according to this embodiment, the arc 4 can be driven and quickly extinguished in a gas space by the permanent magnet 9. Therefore, current switching performance is improved.

Further, according to this embodiment, the permanent magnet 9 is arranged on the inner side of the outer frame 45, i.e., on the inside of the fixed contact 20. Therefore, compared with a configuration in which the permanent magnet 9 is provided on the outside of the fixed contact 20, it is also possible to reduce the dimensions of the entire current switch. In particular, the permanent magnet 9 can be arranged on the inside of the connection conductor 22.

The fixed arc contacts 2 can be provided in the vicinity of the energizing members 31 as well.

Seventh Embodiment

A current switch according to a seventh embodiment further includes a movable arc contact, fixed arc contacts, and a permanent magnet in addition to the components shown in FIGS. 3 and 4.

Figure 11:
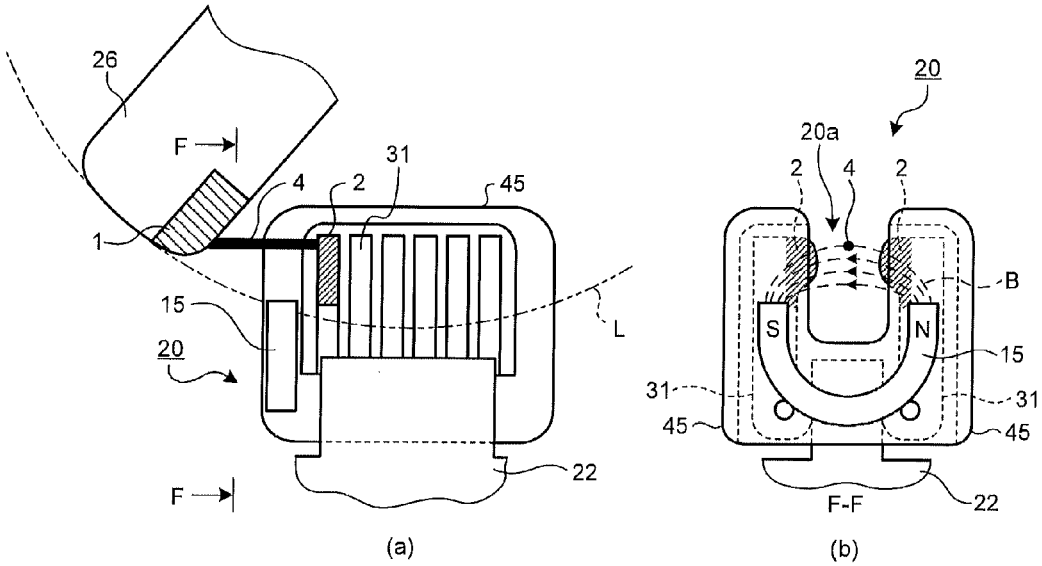
FIG. 11 is a diagram of an arrangement configuration of a movable arc contact, fixed arc contacts, and a permanent magnet in a current switch according to a seventh embodiment.

FIG. 11 is a diagram of an arrangement configuration of the movable arc contact, the fixed arc contacts, and the permanent magnet in the current switch according to this embodiment. (a) is a configuration diagram equivalent to FIG. 3 and (b) is an F-F arrow view of (a). In FIG. 11, components same as the components shown in FIGS. 3 and 4 are denoted by the same reference numerals and signs. In FIG. 11, a part of the components shown in FIGS. 3 and 4 are omitted to mainly show the arrangement configuration of the movable arc contact, the fixed arc contacts, and the permanent magnet.

As shown in FIG. 11, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 11, an arrangement configuration halfway in an opening action of the movable contact 26 is shown. A state in which the arc 4 is generated between the movable arc contact 1 and the fixed arc contacts 2 is also shown.

Further, a generally U-shaped (or a generally C-shaped) permanent magnet 15 having magnetic polarities respectively at both ends is arranged on the inner side of the outer frame 45. The permanent magnet 15 is substantially symmetrically arranged across a pivoting surface (FIG. 11(*b*)). That is, the N pole at one end and the S pole at the other end of the permanent magnet 15 are symmetrically arranged to be opposed to each other on both sides across the pivoting surface.

When viewed from the pivoting center P, the permanent magnet 15 is arranged, for example, further on the outer side in the radial direction than contact and separation points of the movable arc contact 1 and the fixed arc contacts 2. That is, the permanent magnet 15 is arranged further on substantially the outer side in the radial direction than the position of the arc 4 generated between the movable arc contact 1 and the fixed arc contacts 2 during opening of the movable contact 26.

Both the sides of the permanent magnet 15 are respectively housed, for example, in not-shown cases and the cases are attached to the inner side of the outer frame 45. Specifically, the permanent magnet 15 is attached to, for example, the inner side of the outer frame 45 on the movable contact 26 side in the reciprocating moving direction of the movable contact 26. That is, both the sides of the permanent magnet 15 are respectively arranged between the fixed arc contacts 2 and the outer frame 45 and arranged in the vicinity of the contact and separation points of the movable arc contact 1 and the fixed arc contacts 2.

In the generating position of the arc 4, the direction of the magnetic flux density B is substantially parallel to the opposing direction of the energizing members 31 and substantially orthogonal to the arc 4 substantially parallel to the reciprocating moving direction of the movable contact 26.

An operation in this embodiment is the same as the operation in the first embodiment. The arc 4 is generated between the movable arc contact 1 and the fixed arc contacts 2. However, the magnetic flux density B of the permanent magnet 15 arranged in the outer frame 45 is generated in the direction substantially orthogonal to an extending direction of the arc 4 (the reciprocating direction). Therefore, simultaneously with the generation, the arc 4 is subjected to a Lorentz force in a direction orthogonal to both of the magnetic flux density B and the extending direction of the arc 4 (the reciprocating moving direction) and driven by the magnetic flux density B. The arc 4 is effectively cooled and extinguished by an arc-extinguishing insulation gas.

As explained above, according to this embodiment, the arc 4 can be driven and quickly extinguished in a gas space by the permanent magnet 15. Therefore, current switching performance is improved.

Further, according to this embodiment, the permanent magnet 15 is arranged on the inner side of the outer frame 45, i.e., on the inside of the fixed contact 20. Therefore, compared with a configuration in which the permanent magnet 15 is provided on the outside of the fixed contact 20, it is also possible to reduce the dimensions of the entire current switch. In particular, the generally U-shape (or the generally C-shape) of the permanent magnet 15 can be efficiently arranged to extend along the opening section 20*a* of the outer frame 45 making use of internal spaces between the energizing members 31 and the outer frame 45. The fixed arc contacts 2 can be provided in the vicinity of the energizing members 31 as well.

Eighth Embodiment

A current switch according to an eighth embodiment further includes a movable arc contact, fixed arc contacts, and permanent magnets in addition to the components shown in FIGS. 3 and 4.

Figure 12:
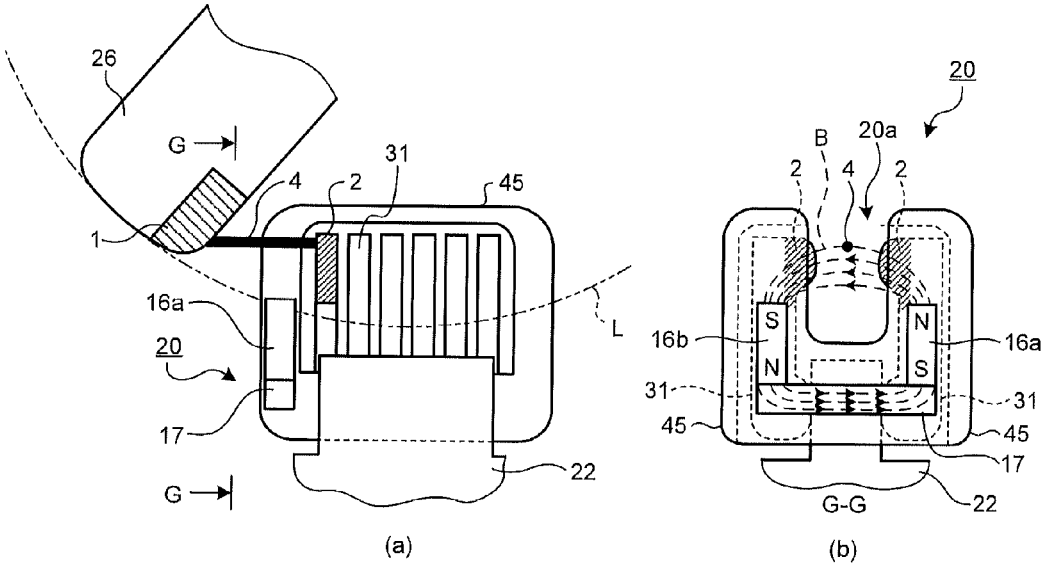
FIG. 12 is a diagram of an arrangement configuration of a movable arc contact, fixed arc contacts, and permanent magnets in a current switch according to an eighth embodiment.

FIG. 12 is a diagram of an arrangement configuration of the movable arc contact, the fixed arc contacts, and the permanent magnets in the current switch according to this embodiment. (a) is a configuration diagram equivalent to FIG. 3 and (b) is a G-G arrow view of (a). In FIG. 12, components same as the components shown in FIGS. 3 and 4 are denoted by the same reference numerals and signs. In FIG. 12, a part of the components shown in FIGS. 3 and 4 are omitted to mainly show the arrangement configuration of the movable arc contact, the fixed arc contacts, and the permanent magnets.

As shown in FIG. 12, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 12, an arrangement configuration halfway in an opening action of the movable contact 26 is shown. A state in which the arc 4 is generated between the movable arc contact 1 and the fixed arc contacts 2 is also shown.

Further, for example, a pair of permanent magnets 16*a* and 16*b* is arranged on the inner side of the outer frame 45. Specifically, both the permanent magnets 16*a* and 16*b* are arranged such that magnetizing directions of the permanent magnets 16*a* and 16*b* are substantially parallel to the pivoting surface of the movable contact 26 and substantially orthogonal to the reciprocating moving direction of the movable contact 26.

When viewed from the pivoting center P, the permanent magnets 16*a* and 16*b* are arranged further on the outer sides in the radial direction than contact and separation points of the movable arc contact 1 and the fixed arc contacts 2. That is, the permanent magnets 16*a* and 16*b* are arranged further on the substantial outer sides in the radial direction than the position of the arc 4 generated between the movable arc contact 1 and the fixed arc contacts 2 during opening of the movable contact 26.

The permanent magnets 16*a* and 16*b* are arranged to be opposed to each other across the opening section 20*a*. That is, the permanent magnets 16*a* and 16*b* are arranged to be opposed to each other on both sides across the pivoting surface. Magnetizing directions of the permanent magnets 16*a* and 16*b* are, for example, opposite to each other. That is, for example, the N pole of the permanent magnet 16*a* and the S pole of the permanent magnet 16*b* are opposed to each other and the S pole of the permanent magnet 16*a* and the N pole of the permanent magnet 16*b* are opposed to each other across the pivoting surface. Each of the permanent magnets 16*a* and 16*b* is, for example, columnar.

Further, the end on the S pole side of the permanent magnet 16*a* and the end on the N pole side of the permanent magnet 16*b* are coupled to each other by a coupling section 17 made of a ferromagnetic body. The coupling section 17 is made of, for example, a heel piece. The permanent magnets 16*a* and 16*a* are coupled to be formed in a generally C-shape (or a generally U-shape) by the coupling section 17. A generally C-shaped (or generally U-shaped) magnetic path is formed in the permanent magnets 16*a* and 16*b* and the coupling section 17. The magnetic flux density B in a direction substantially orthogonal to the pivoting surface in the opening section 20*a* increases.

The permanent magnets 16*a* and 16*b* and the coupling section 17 are housed, for example, in not-shown cases and the cases are attached to the inner side of the outer frame 45. Specifically, the permanent magnets 16*a* and 16*b* and the coupling section 17 are attached to, for example, the inner side of the outer frame 45 on the movable contact 26 side in the reciprocating moving direction of the movable contact 26. That is, the permanent magnets 16*a* and 16*b* and the coupling section 17 are arranged between the fixed arc contacts 2 and the outer frame 45 and arranged in the vicinity of the contact and separation points of the movable arc contact 1 and the fixed arc contacts 2.

In the generating position of the arc 4, the direction of magnetic flux density B is substantially orthogonal to the magnetizing directions of the permanent magnets 16*a* and 16*b* and substantially orthogonal to the arc 4 substantially parallel to the reciprocating moving direction of the movable contact 26 (FIG. 12(*b*)).

An operation in this embodiment is the same as the operation in the first embodiment. The arc 4 is generated between the movable arc contact 1 and the fixed arc contacts 2. However, the magnetic flux density B generated by the permanent magnets 16*a* and 16*b* arranged in the outer frame 45 and coupled to each other by the coupling section 17 is generated in the direction substantially orthogonal to the arc 4. Therefore, simultaneously with the generation, the arc 4 is subjected to a Lorentz force in a direction orthogonal to both of the magnetic flux density B and an extending direction of the arc 4 (the reciprocating moving direction) and driven by the magnetic flux density B. The arc 4 is effectively cooled and extinguished by an arc-extinguishing insulation gas.

As explained above, according to this embodiment, the arc 4 can be driven and quickly extinguished in a gas space by the permanent magnets 16*a* and 16*b* coupled to each other by the coupling section 17 made of the ferromagnetic body. Therefore, current switching performance is improved.

Further, according to this embodiment, the permanent magnets 16*a* and 16*b* and the coupling section 17 are arranged on the inner side of the outer frame 45, i.e., on the inside of the fixed contact 20. Therefore, compared with a configuration in which the permanent magnets 16*a* and 16*b* and the coupling section 17 are provided on the outside of the fixed contact 20, it is also possible to reduce the dimensions of the entire current switch. In particular, the generally C-shape (or the generally U-shape) of the permanent magnets 16*a* and 16*b* and the coupling section 17 can be efficiently arranged along the opening section 20*a* of the outer frame 45 making use of internal spaces between the energizing members 31 and the outer frame 45.

According to this embodiment, the pair of permanent magnets 16*a* and 16*b* is provided in the vicinity of the arc 4 across the pivoting surface such that different polarities of the permanent magnets 16*a* and 16*b* are opposed to each other. Therefore, it is possible to increase the magnetic flux density B orthogonal to the extending direction of the arc 4 (the reciprocating moving direction) in the vicinity of the arc 4. Further, according to this embodiment, the permanent magnets 16*a* and 16*b* are coupled by the coupling section 17 made of the ferromagnetic body. Therefore, it is possible to reduce the magnetic flux density B distributed other than the vicinity of the arc 4 and further increase the magnetic flux density B orthogonal to the extending direction of the arc 4 (the reciprocating moving direction). The extinction of the arc 4 is further facilitated.

The fixed arc contacts 2 are provided, for example, at the distal ends of the energizing members 31. However, the fixed arc contacts 2 can be provided in the vicinity of the energizing members 31 as well.

Ninth Embodiment

A current switch according to a ninth embodiment further includes a movable arc contact, fixed arc contacts, and a permanent magnet in addition to the components shown in FIGS. 3 and 4.

Figure 13:
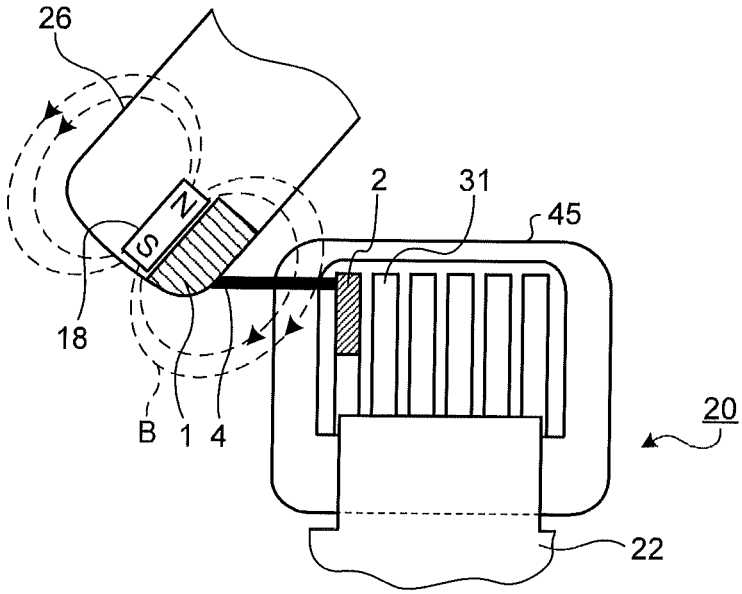
FIG. 13 is a diagram of an arrangement configuration of a movable arc contact, fixed arc contacts, and a permanent magnet in a current switch according to a ninth embodiment.

FIG. 13 is a diagram of an arrangement configuration of the movable arc contact, the fixed arc contacts, and the permanent magnet in the current switch according to this embodiment. FIG. 13 is a configuration diagram equivalent to FIG. 3. In FIG. 13, components same as the components shown in FIG. 3 are denoted by the same reference numerals and signs. In FIG. 13, a part of the components shown in FIG. 3 are omitted to mainly show the arrangement configuration of the movable arc contact, the fixed arc contacts, and the permanent magnet.

As shown in FIG. 13, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 13, an arrangement configuration halfway in an opening action of the movable contact 26 is shown. A state in which the arc 4 is generated between the movable arc contact 1 and the fixed arc contacts 2 is also shown.

Further, a permanent magnet 18 is arranged on the inside of the movable contact 26. The permanent magnet 18 is arranged in the vicinity of the movable arc contact 1. Therefore, the permanent magnet 18 is arranged in the vicinity of contact and separation points of the movable arc contact 1 and the fixed arc contacts 2.

A magnetizing direction of the permanent magnet 18 is arranged, for example, substantially in parallel to an extending direction (the radial direction) of the movable contact 26. The permanent magnet 18 is, for example, columnar.

For example, after being housed in a housing hole provided in the movable contact 26, the permanent magnet 18 can be attached in the movable contact 26 by closing the hole.

In the generating position of the arc 4, the direction of magnetic flux density B is substantially orthogonal to the arc 4 substantially parallel to the reciprocating moving direction of the movable contact 26 (FIG. 13).

An operation in this embodiment is explained. For example, an opening operation is explained below. However, a closing operation is the same. In a closed-circuit state, the movable contact 26 is in contact with the energizing members 31. However, during opening, first, the movable contact 26 and the energizing members 31 separate from each other and, subsequently, the movable arc contact 1 and the fixed arc contacts 2 separate from each other. Therefore, the arc 4 is generated between the movable arc contact 1 and the fixed arc contacts 2. However, the magnetic flux density B of the permanent magnet 18 arranged in the movable contact 26 is generated in a direction substantially orthogonal to the arc 4. Therefore, simultaneously with the generation, the arc 4 is subjected to a Lorentz force in a direction orthogonal to both of the magnetic flux density B and an extending direction of the arc 4 (the reciprocating moving direction) and driven by the magnetic flux density B. The arc 4 is effectively cooled and extinguished by an arc-extinguishing insulation gas.

As explained above, according to this embodiment, the arc 4 can be driven and quickly extinguished in a gas space by the permanent magnet 18. Therefore, current switching performance is improved.

Further, according to this embodiment, the permanent magnet 18 is arranged on the inside of the movable contact 26. Therefore, compared with a configuration in which the permanent magnet 18 is provided on the outside of the fixed contact 20, it is also possible to reduce the dimensions of the entire current switch.

The fixed arc contacts 2 are provided, for example, at the distal ends of the energizing members 31. However, the fixed arc contacts 2 can also be provided in the vicinity of the energizing members 31.

Tenth Embodiment

A current switch according to a tenth embodiment further includes a movable arc contact, fixed arc contacts, and a permanent magnet in addition to the components shown in FIGS. 3 and 4.

Figure 14:
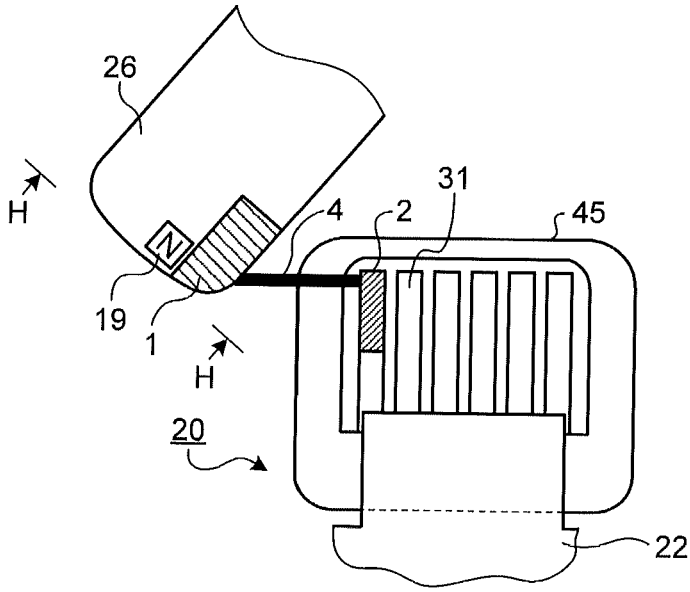
FIG. 14 is a diagram of an arrangement configuration of a movable arc contact, fixed arc contacts, and a permanent magnet in a current switch according to a tenth embodiment.
Figure 15:
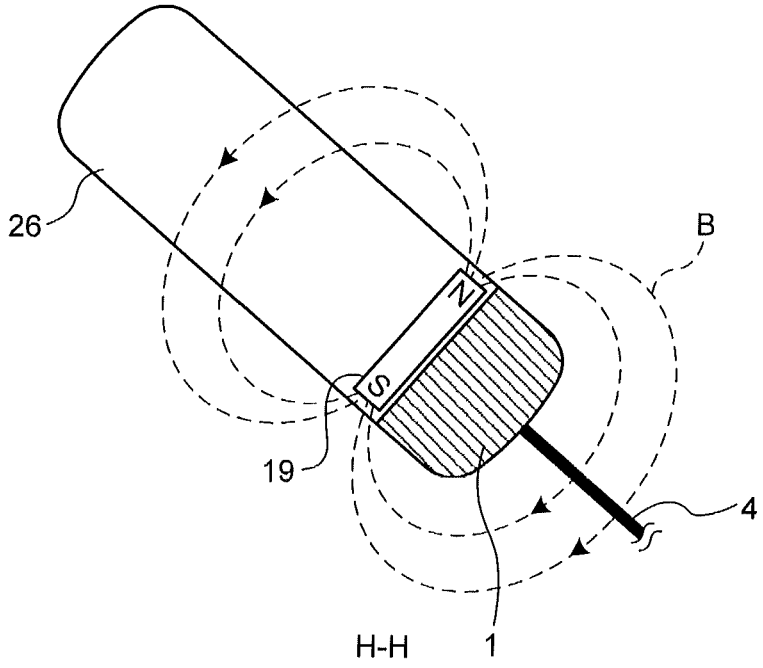
FIG. 15 is an H-H arrow view in FIG. 14 and an enlarged view of a distal end of a movable contact.

FIG. 14 is a diagram of an arrangement configuration of the movable arc contact, the fixed arc contacts, and the permanent magnet in the current switch according to this embodiment. FIG. 14 is a configuration diagram equivalent to FIG. 3. FIG. 15 is an H-H arrow view in FIG. 14 and an enlarged view of the distal end of a movable contact. In FIGS. 14 and 15, components same as the components shown in FIG. 3 are denoted by the same reference numerals and signs. In FIG. 14, a part of the components shown in FIG. 3 are omitted to mainly show the arrangement configuration of the movable arc contact, the fixed arc contacts, and the permanent magnet.

As shown in FIG. 14, the movable arc contact 1 formed of an arc-proof material such as a copper-tungsten alloy is provided at the distal end of the movable contact 26. The movable arc contact 1 is provided at the distal end on the fixed contact 20 side of the movable contact 26 in a reciprocating moving direction of the movable contact 26. In other words, the movable arc contact 1 is provided at the distal end of the movable contact 26 on a side on which the movable contact 26 is in contact with the fixed contact 20 to the end during opening. The movable arc contact 1 is provided to cover a part of each of both surfaces of the movable arc contact 1 parallel to a pivoting surface and a part of an end face between both the surfaces.

The fixed arc contacts 2 are also formed of an arc-proof material such as a copper-tungsten alloy and provided on the inner side of the outer frame 45, i.e., in the fixed contact 20. Specifically, the fixed arc contacts 2 are provided at the distal ends of a pair of energizing members 31 arranged closest to the movable contact 26 side in the reciprocating moving direction of the movable contact 26. In FIG. 14, an arrangement configuration halfway in an opening action of the movable contact 26 is shown. A state in which the arc 4 is generated between the movable arc contact 1 and the fixed arc contacts 2 is also shown.

In this embodiment, a permanent magnet 19 is arranged on the inside of the movable contact 26. The permanent magnet 19 is arranged in the vicinity of the movable arc contact 1. Therefore, the permanent magnet 18 is arranged in the vicinity of contact and separation points of the movable arc contact 1 and the fixed arc contacts 2.

A magnetizing direction of the permanent magnet 19 is arranged, for example, substantially orthogonal to the pivoting surface of the movable contact 26. The permanent magnet 19 is, for example, columnar.

For example, after being housed in a housing hole provided in the movable contact 26, the permanent magnet 19 can be attached in the movable contact 26 by closing the hole.

In the generating position of the arc 4, the direction of magnetic flux density B is substantially orthogonal to the arc 4 substantially parallel to the reciprocating moving direction of the movable contact 26 (FIG. 15).

An operation in this embodiment is the same as the operation in the ninth embodiment. The arc 4 is generated between the movable arc contact 1 and the fixed arc contacts 2. However, the magnetic flux density B of the permanent magnet 19 arranged in the movable contact 26 is generated in a direction substantially orthogonal to the arc 4. Therefore, simultaneously with the generation, the arc 4 is subjected to a Lorentz force in a direction orthogonal to both of the magnetic flux density B and an extending direction of the arc 4 (the reciprocating moving direction) and driven by the magnetic flux density B. The arc 4 is effectively cooled and extinguished by an arc-extinguishing insulation gas.

As explained above, according to this embodiment, the arc 4 can be driven and quickly extinguished in a gas space by the permanent magnet 19. Therefore, current switching performance is improved.

Further, according to this embodiment, the permanent magnet 19 is arranged on the inside of the movable contact 26. Therefore, compared with a configuration in which the permanent magnet 19 is provided on the outside of the fixed contact 20, it is also possible to reduce the dimensions of the entire current switch.

The fixed arc contacts 2 are provided, for example, at the distal ends of the energizing members 31. However, the fixed arc contacts 2 can also be provided in the vicinity of the energizing members 31.

In the first to tenth embodiments, the permanent magnet(s) is (are) arranged such that the magnetic flux density B of the permanent magnet(s) and the arc 4 are substantially orthogonal to each other. However, even if the magnetic flux density B and the arc 4 are not substantially orthogonal to each other, the arc 4 can be driven if the magnetic flux density B and the arc 4 cross each other. Therefore, likewise, there is an effect of improving the current switching performance. However, the arc 4 can be most effectively driven when the magnetic flux density B and the arc 4 are orthogonal to each other.

INDUSTRIAL APPLICABILITY

As explained above, the present invention is useful as, for example, a current switch in a gas insulated switching device.

REFERENCE SIGNS LIST

1 movable arc contact
2 fixed arc contacts
3*a*, 3*b*, 5*a*, 5*b*, 6*a*, 6*b*, 7*a*, 7*b* permanent magnets
4 arc
8, 9, 15, 16*a*, 16*b*, 18, 19 permanent magnets
10 tank
11 main bus
12 insulated spacer
17 coupling section
20 fixed contact
20*a* opening section
21 fixed side supporting conductor
22 connection conductor
22*a* projecting section
23 fixed contact for grounding
25 fixed side supporting conductor for grounding
26 movable contact
26*a* free end
27 slit conductors
28 movable side supporting conductor
29 spacer connection conductor
30 insulated operating shaft (rotating shaft)
31 energizing members
33 supporting frame
35 supporting bar
37 fastening member
41 slip-off preventing member
43 leaf spring
45 outer frame

The invention claimed is:

1. A current switch comprising:

a blade-type movable contact configured to extend in a radial direction from a pivoting center and reciprocatingly move such that a free end of the movable contact draws a pivoting track;

a fixed contact including energizing members separated from the movable contact and arranged to be opposed to and substantially in parallel to each other on both sides across a pivoting surface of the movable contact and a shielding member configured to cover at least a periphery of the energizing members and shield the periphery of the energizing members from an external electric field and provided with an opening section substantially U-shaped in section into which the movable contact can penetrate;

a movable arc contact provided in the movable contact;

fixed arc contacts provided in the fixed contact; and a permanent magnet arranged on an inside of the fixed contact to generate a magnetic field that crosses an arc generated between the movable arc contact and the fixed arc contacts during contact and separation of the movable contact and the fixed contact, wherein at least an end of the permanent magnet is arranged in a vicinity of contact and separation points of the movable arc contact and the fixed arc contacts, arranged such that a magnetizing direction of the permanent magnet is substantially parallel to the pivoting surface of the movable contact and substantially orthogonal to a reciprocating moving direction of the movable contact, and, when viewed from the pivoting center, arranged further on an outer side in the radial direction than the contact and separation points of the movable arc contact and the fixed arc contacts.

2. The current switch according to claim 1, wherein the permanent magnet is located substantially on the pivoting surface of the movable contact.

3. The current switch according to claim 1, wherein a pair of the permanent magnets are respectively arranged on both sides across the pivoting surface of the movable contact.

4. The current switch according to claim 3, wherein magnetizing directions of the permanent magnets are opposite to each other.

5. The current switch according to claim 4, wherein the permanent magnets respectively arranged on both the sides across the pivoting surface are coupled to each other by a coupling section made of a ferromagnetic body and form a substantially U-shaped magnetic path in conjunction with the coupling section.

6. The current switch according to claim 3, wherein magnetizing directions of the permanent magnets are the same each other.

7. A current switch comprising:

a blade-type movable contact configured to extend in a radial direction from a pivoting center and reciprocatingly move such that a free end of the movable contact draws a pivoting track;

a fixed contact including energizing members separated from the movable contact and arranged to be opposed to and substantially in parallel to each other on both sides across a pivoting surface of the movable contact and a shielding member configured to cover at least a periphery of the energizing members and shield the periphery of the energizing members from an external electric field and provided with an opening section substantially U-shaped in section into which the movable contact can penetrate;

a movable arc contact provided in the movable contact;

fixed arc contacts provided in the fixed contact; and a permanent magnet arranged on an inside of the fixed contact to generate a magnetic field that crosses an arc generated between the movable arc contact and the fixed arc contacts during contact and separation of the movable contact and the fixed contact, wherein at least an end of the permanent magnet is arranged in a vicinity of contact and separation points of the movable arc contact and the fixed arc contacts, arranged such that a magnetizing direction of the permanent magnet is substantially orthogonal to the pivoting surface of the movable contact, and, when viewed from the pivoting center, arranged further on an outer side in the radial direction than the contact and separation points of the movable arc contact and the fixed arc contacts.

8. The current switch according to claim 7, wherein a pair of the permanent magnets are respectively arranged on both sides across the pivoting surface of the movable contact.

9. The current switch according to claim 8, wherein magnetizing directions of the permanent magnets are opposite to each other.

10. The current switch according to claim 8, wherein magnetizing directions of the permanent magnets are the same each other.

11. A current switch comprising:

a blade-type movable contact configured to extend in a radial direction from a pivoting center and reciprocatingly move such that a free end of the movable contact draws a pivoting track;

a fixed contact including energizing members separated from the movable contact and arranged to be opposed to and substantially in parallel to each other on both sides across a pivoting surface of the movable contact and a shielding member configured to cover at least a periphery of the energizing members and shield the periphery of the energizing members from an external electric field and provided with an opening section substantially U-shaped in section into which the movable contact can penetrate;

a movable arc contact provided in the movable contact;

fixed arc contacts provided in the fixed contact; and a permanent magnet arranged on an inside of the movable contact to generate a magnetic field that crosses an arc generated between the movable arc contact and the fixed arc contacts during contact and separation of the movable contact and the fixed contact, wherein the permanent magnet is arranged in a vicinity of the movable arc contact.

12. The current switch according to claim 11, wherein a magnetizing direction of the permanent magnet is substantially parallel to an extending direction of the movable contact.

13. The current switch according to claim 11, wherein a magnetizing direction of the permanent magnet is substantially orthogonal to the pivoting surface of the movable contact.

* * * * *